United States Patent [19]

Henneman et al.

[11] 3,976,063

[45] Aug. 24, 1976

[54] ESCAPE BREATHING APPARATUS

[75] Inventors: John W. Henneman; Duane E. Hinds, both of Davenport, Iowa

[73] Assignee: The Bendix Corporation, South Bend, Ind.

[22] Filed: Sept. 16, 1974

[21] Appl. No.: 506,497

[52] U.S. Cl. ..... 128/142.7; 128/203; 128/209

[51] Int. Cl.[2] ..... A62B 7/04

[58] Field of Search ..... 128/142, 142.2, 142.3, 128/142.4, 142.5, 142.6, 142.7, 145 R, 145.8, 146, 146.3, 146.4, 146.5, 146.6, 146.7, 191 R, 202, 203; 190/41 Z

[56] References Cited

UNITED STATES PATENTS

| | | | |
|---|---|---|---|
| 2,432,001 | 12/1947 | Fisher | 190/41 Z |
| 2,529,106 | 11/1950 | Schauweker | 128/142.5 |
| 2,537,265 | 1/1951 | Gemunden | 128/142.7 |
| 2,767,758 | 10/1956 | Haynes | 190/41 Z |
| 2,804,071 | 8/1957 | Johnston | 128/142 |
| 3,136,312 | 6/1964 | Gattone | 128/203 |
| 3,390,676 | 7/1968 | Warncke et al. | 128/142.2 |
| 3,400,713 | 9/1968 | Finan | 128/203 |
| 3,565,068 | 2/1971 | Bickford | 128/142 |
| 3,577,988 | 5/1971 | Jones | 128/142.7 |
| 3,655,346 | 4/1972 | Cotabish et al. | 128/142.6 |
| 3,739,774 | 6/1973 | Gregory | 128/142.7 |
| 3,762,407 | 10/1973 | Shonerd | 128/142.3 |
| 3,863,629 | 2/1975 | Ries | 128/142 |

FOREIGN PATENTS OR APPLICATIONS

| | | | |
|---|---|---|---|
| 870,827 | 12/1941 | France | 128/142 |

*Primary Examiner*—Robert W. Michell
*Assistant Examiner*—Henry J. Recla
*Attorney, Agent, or Firm*—Leo H. McCormick, Jr.; W. N. Antonis

[57] ABSTRACT

A method and system for supplying a person with breathable fluid in an irrespirable atmosphere. A package which is attached to a person holds a container having a valve which is activated upon removal of a protective cover. The valve allows a breathable fluid to flow at a variable rate to a supply conduit. The supply conduit is connected to a reservoir. An inhalation check valve connects the supply conduit to the person. Upon inhalation, the check valve will open and allow breathable fluid to flow from the supply conduit. Upon exhalation, the inhalation check valve closes and an exhalation check valve opens to permit the breathed air to flow through a filter where carbon dioxide is removed before returning to be mixed with breathable fluid in the supply conduit.

11 Claims, 8 Drawing Figures

ESCAPE BREATHING APPARATUS

BACKGROUND OF THE INVENTION

Escape from the interior "hold" of a vessel to the weather deck may be impossible during a fire because many of the interconnecting passageways will be filled with irrespirable atmosphere. In the past, breathing apparatus, such as that described in U.S. Pat. No. 3,692,026, have been suggested as a means for making a safe escape through the irrespirable atmosphere. However, because of the physical size of such a breathing apparatus, storage in the "hold" has not met with success since each crewman would need such a safety escape apparatus within easy reach in several locations throughout the ship. In addition, the time required to outfit a single person is longer than most people can stand still in time of an emergency

SUMMARY OF THE INVENTION

We have devised a modular escape breathing system which is retained in a sealed package which can be easily stored at many locations throughout the hold of a vessel. The sealed package has a zipper or D-ring means attached to a first valve means on a storage cylinder located within the package. When the zipper or D-ring means is pulled to open the seal, the first valve is actuated to allow a breathable fluid to flow into a supply conduit attached to a plastic reservoir. A second valve means connected to the plastic reservoir controls the flow therefrom in response to a demand by a person. A fire resistant plastic hood connected to the second valve means forms a seal with at least the nose and mouth of the person to prevent any of the irrespirable atmosphere from entering the lungs of the person. The top of the hood means has a cap of a metalized material to reflect any thermal energy present in the irrespirable atmosphere away from the head of the person. A curtain extends from the hood means to cover the shoulder area of the person and offers further protection from the irrespirable atmosphere.

In a secondary embodiment the second valve means is connected to a bubble means which completely encloses in the person's head. This will afford protection to the person's eyes in addition to providing continuous cooling for the head area as a breathable fluid flows from the second valve means.

It is therefore the object of this invention to provide a closed loop breathing system which can be effectively stored over an extended period of time in various locations to provide an emergency breathing system in time of escape from an irrespirable atmosphere.

It is another object of this invention to provide a closed loop breathing system with the means for protecting a person from the head to the shoulders and partially across the chest with a covering to prevent any harmful effects from an irrespirable atmosphere reaching a person's eyes, nose, mouth and lungs.

It is a further object of this invention to provide a closed loop breathing system with a hood means having an injection valve for automatically mixing breathed fluid from which carbon dioxide and water vapor has been removed with breathable fluid from a reservoir to sustain the metabolic oxygen consumption of a person.

It is a still further object of this invention to provide a closed loop breathing system with a storage means for retaining an oxygen enriched breathable fluid for sustaining the metabolic needs of a person for a predetermined period of time.

These and other objects of this invention will become apparent from reading this specification and viewing the drawings.

DETAILED DESCRIPTION OF THE PREFERRED EMBODIMENT

Figure 2:
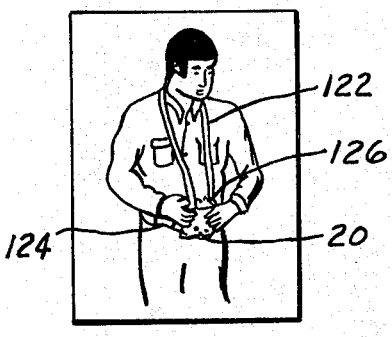
FIGS. 2–6 illustrate the sequential steps necessary for deployment of a closed loop breathing system shown in FIG. 1.
Figure 1:
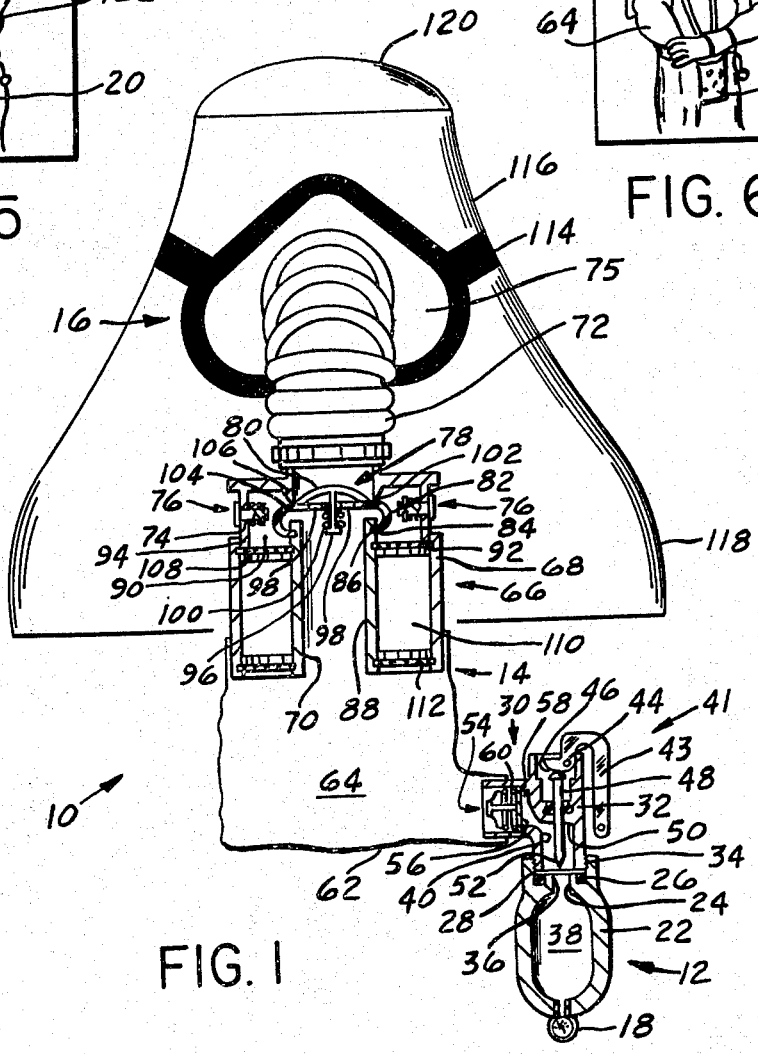
FIG. 1 is a sectional view of the component parts in a closed loop emergency breathing system.

The closed loop breathing system 10 shown in FIG. 1 has a storage container means 12 connected by a supply means 14 to a distribution mask means 16. The storage container means 12 is designed to hold a fixed quantity of breathable fluid, whose oxygen concentration can vary from 21% to 100%, to sustain the metabolic needs of a person for a limited time, as indicated on gauge 18. For use with a sea going vessel this time is designed to be between 10–20 minutes. This will allow for a compact package 20, as shown in FIG. 2, to be easily carried by a person.

The storage container means 12 includes a bottle 22 with an opening 24 into which an O-ring seal 26 is inserted in front of a metal stopper 28.

A first control valve means 30 has a housing 32 with a neck 34 which is screwed into the bottle 22 to hold the metal stopper 28 against a seat 36 and the O-ring seal 34 to retain the breathable fluid in bottle 22 within chamber 38. The housing 32 has a passageway 40 for the communication of the breathable fluid from chamber 38 into the supply means 14 upon the actuator means 41 being activated by the operator pulling a zipper or O-ring 42 to remove the component parts from the package means 20.

The actuator means 41 has a handle 43 which is located on pin 44 to position cam surface 46 against shaft 48. The shaft 48 is aligned within the housing 32 by a bearing wall 50 such that movement of the handle 43 causes head 52 to rupture the metal stopper 28.

A restrictive means 54 has a face 56 which is urged toward a seat 58 by a spring 60 for controlling the rate of flow of the breathable fluid from the chamber 38 through the flow path 40 into the supply means 14.

The supply means 14 includes a conduit 62 which expands into a storage reservoir 64. The storage reservoir 64 terminates into a second control valve means 66.

The second control valve means 66 has a housing 68 with an axial passage 70 to which conduit 72 going to face mask 75 is attached. The housing 68 has a tubular section 88 to define the axial passage 70. The tubular section 88 extends into a relief chamber 90 until shoulder 92 engages wall 94. The relief chamber 90 has a plurality of openings 74 into which a corresponding relief valve 76 is located. A control valve means 78 has a first poppet 82 which has a rib 84 snapped into a groove 86 adjacent the end of the tubular section 88 and a second poppet 80 which has a stem 96 located on the first poppet 82. The first poppet 82 has a series of holes 98 located under the second poppet 80. A spring 100 acting on the stem 96 urges the second popper 80 toward a seat 102 on the first poppet 82 to seal the reservoir 64 from the conduit 72. The breathable fluid in the reservoir 64 being under pressure acts on the first poppet 82 to urge rib 104 against seat 106 to segregate the relief chamber 90 from conduit 72.

A first annular screen 108 and a second annular screen 112 located on the tubular section 88 extends to the housing 68 for retention of a quantity of filtering material 110, such as baralyme, for the removal of water vapor and carbon dioxide from breathed fluid which is exhaled by the person wearing the face mask 75.

The face mask 75 has a strap 114 which holds the face mask 75 over the nose and mouth of the person to form an elastomeric seal to prevent irrespirable gasses from entering the lungs of the person.

The distribution mask means 16, which includes a hood 116 and protective curtain 118, and the supply means 14, which includes the reservoir 64, are made of a plastic manufactured by DuPont under the trademark of "Kapton". "Kapton" has the following characteristics: melting point - none; cut through temperature - 435° C; Flammability - self-extinguishing; heat aging - 8 years at 250° C; oxygen permeability - negligible; and shrinkage - 3.5% at 400° C.

The hood 116 has a metalized cap, such as aluminum, 120 located in the top thereof to reflect away any thermal energy which may be present in the irrespirable atmosphere.

MODE OF OPERATION OF THE PREFERRED EMBODIMENT

Figure 3:
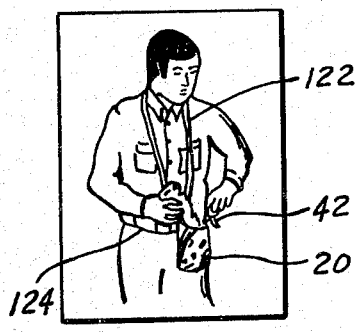
Figure 4:
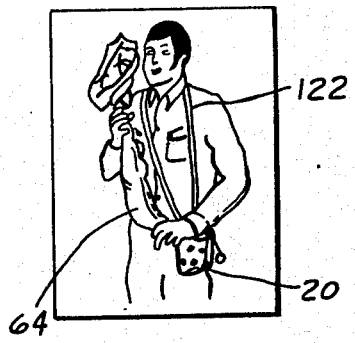
Figure 5:
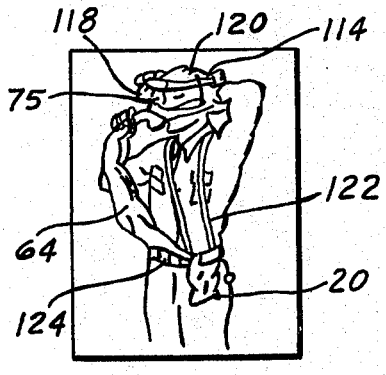

When a person finds himself confronted with an irrespirable atmospheric condition which is protected by an emergency escape breathing apparatus system 10, a package 20 is removed from an identified storage compartment. The person will initially check gauge 18 to inform himself of the amount of stored breathable fluid (measured in time) available in the container means 12. Upon taking a package 20 from storage, the person will first put strap 122 over his head and then secure the package to his waist or torso by means of clips 126 attached to belt 124 as shown in FIG. 2. Zipper pull or D-ring 42 of the zipper or fastener means is then pulled to remove a protective plastic covering over the package 20 in a manner as shown in FIG. 3. The person can now reach into the package 20 and remove the face mask means 16. Zipper 42, upon being pulled, will move handle 43 to cause head 52 to penetrate the metal stopper 28 and allow breathable fluid to flow into the reservoir 64 past restriction means 54 of the first valve means 30. As the face mask means 16 is extended, as shown in FIG. 4, the reservoir 64 will rapidly be filled causing the first poppet or exhalation valve 82 to be urged against seat 106. The person will now pull strap 114 over his head and position the face mask 75 over his nose and mouth, as shown in FIG. 5. The reservoir 64 which rapidly fills with the breathable fluid when the zipper 42 is pulled, will permit the person to immediately breath through the face mask 75. With the face mask 75 in place, curtain 118 is now placed over the shoulders to offer further protection from the irrespirable atmosphere.

When a person wearing the mask 75 inhales, spring 100 is overcome allowing the breathable fluid to flow from the reservoir 64 through the axial passageway 70.

When the inhalation demand ceases, spring 100 again seats the second poppet or inhalation valve 80 on seat 102. As the person exhales, the first poppet 82 is moved off of seat 106 allowing the breathed fluid to pass into the relief chamber 90 forcing at least a portion of this air through the filtering material 110 to remove the carbon dioxide and water vapor contained therein before being returned to the reservoir 64 where mixing takes place. If the fluid pressure of the breathable fluid in the reservoir is above a certain value, relief valve means 76 will open and allow a fixed quantity to escape into the atmosphere rather than pressurizing the lung of the person or rendering the unseating of the first poppet 82 too difficult.

Figure 6:
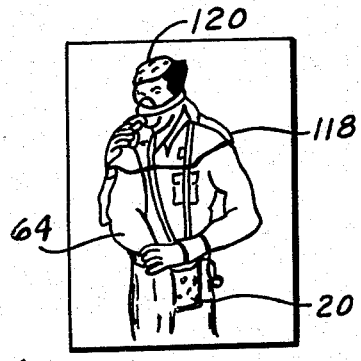

As shown in FIG. 6, with the curtain 118 and the reservoir 64 covering the shoulders and chest of the person, a substantial part of the more delicate parts of the body are protected from any adverse effects which may result from the irrespirable atmosphere.

Figure 7:
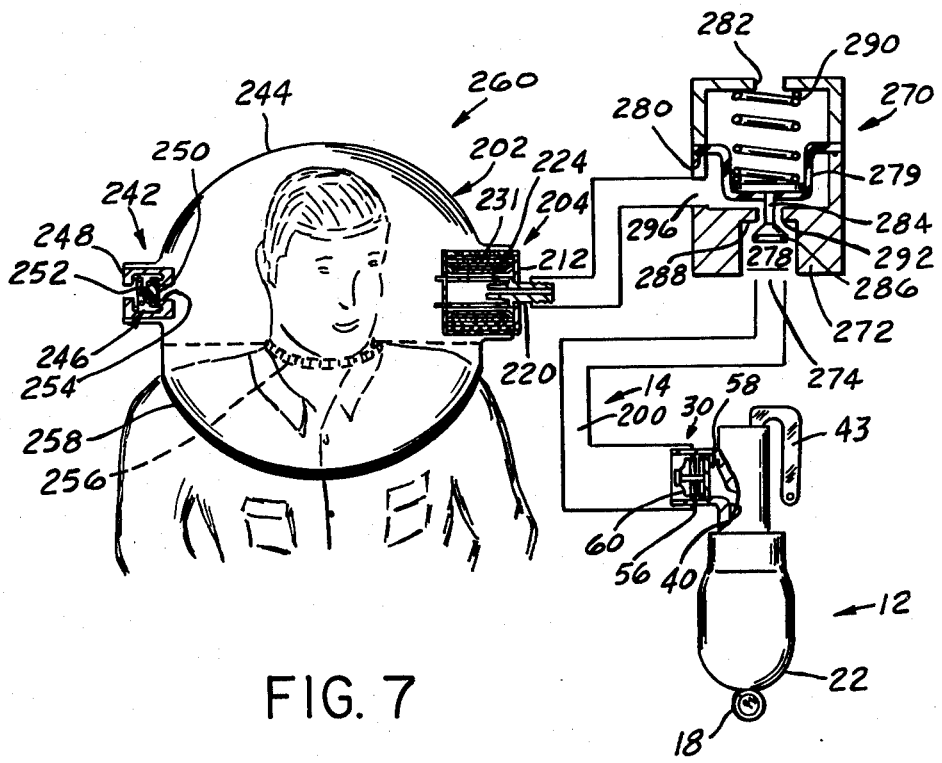
FIG. 7 is a sectional view of the component parts of another closed loop emergency breathing system.

The embodiment shown in FIG. 7 having like parts of FIG. 1 are identified with the same numeral.

The supply means 14 is a single conduit 200 which is connected through a pressure reducer means 270 to a hood means 202 through a second valve means 204.

The pressure reducer means 270 includes a housing 272 having a control chamber 278 with an entrance port 274 and an exit port 296 connected to the single conduit 200. A diaphragm 279 has a bead 280 which is secured to the housing 272 to separate the exit port 296 from an atmospheric port 282. A stem 284 has a tapered face 286 which is located adjacent a wall 288 between the entrance port 274 and the exit port 296. A spring 290 is located between the housing 272 and the diaphragm 279 to hold the tapered face 286 away from the seat 292. When the flow of breathable fluid through conduit 200 commences, the pressure differential across the diaphragm 279 will overcome the spring 290 and seat the tapered face 286 on seat 292. As the flow demand in second valve means 204 is depleted, spring 290 will overcome the pressure differential and allow the more breathable fluid to flow past the seat and out the exit port 296 for distribution to the hood means 202.

Figure 8:
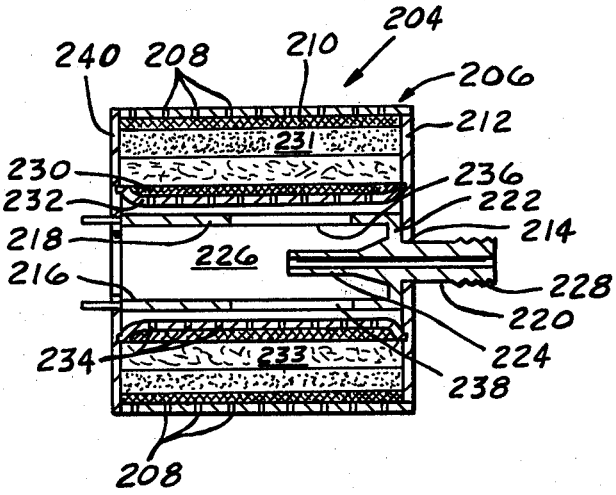
FIG. 8 is a sectional view of an injector mixing nozzle means for the emergency breathing system in FIG. 7.

The second valve means 204, as seen in FIG. 8 has a cylindrical body 206 with a plurality of radial openings 208 therein. A first end 212 attached to the cylindrical body 206 has an axial opening 214 therethrough. A tube 216 has a large diameter section 218 separated from a smaller diameter section 220 by a shoulder 222. An injector nozzle 224 extends from the shoulder 222 into an expansion mixing chamber 226. The smaller diameter section 220 is attached to the single conduit 200 by gripping surface 228. A first screen 210 is concentrically located adjacent the cylindrical body 206 and a second screen 230 is located adjacent a spacer member 232. A spacer member 232 has a plurality of radial openings 234 therein which are connected through openings 236 and 238 to the mixing chamber 226. The space between the first screen 210 and the second screen 230 is filled with a filter material 231. The filter material 231 has a vapor barrier 233, located adjacent the screen 230, and a scrubber, such as baralyme, extending to the screen 210, for removing water vapor and carbon dioxide from the flow stream to the mixing chamber 226. A second end 240 is attached to the cylindrical body 206, the spacer member 232, and the larger diameter section 218 of the tube to form a unitary structure for the second valve means 204.

A relief valve means 242 is attached to the flexible plastic hood 202 to form a bubble 244 which is created upon the oxygen or other breathable fluid being allowed to flow in conduit 200. The relief valve has a poppet means 246 which is retained in a housing 248. The poppet means 246 includes a disc 250 which is urged against seat 254 by spring 252. The spring 252 is chosen such that fluid pressure in the bubble 244 will approach 30 psi when seal 256 is secured around the neck of the person. The curtain 258 extends from the bubble 244 to offer protection to the shoulder, chest and back area of the person wearing the emergency escape breathing apparatus 260.

Upon moving handle 43 during removal of the protective covering around the packaging means 20, oxygen or other breathable fluid will flow in flow path 40 to the first valve means 30 through the restriction means 54 into the supply conduit 200. The breathable fluid under pressure upon passing through the pressure reducer means 270 will be transmitted to the injector 224 to cause a pressure differential to be created across the fluid filter means 210. This pressure differential will cause breathed fluid in the bubble 244 to flow through the filter means 231 into the mixing chamber 226 where it is combined with the oxygen or other breathable fluid being delivered through the injector 224. Through this arrangement the quality of breathable fluid inhaled over a period of time is sufficient to maintain the metabolic oxygen consumption of the person during an emergency escape situation.

We claim:

1. A closed loop breathing system for providing emergency protection from an irrespirable atmosphere, said system comprising:

package means attachable to the waist of a person;

covering means attached to said package means to prevent the transmission of contaminants into the interior of the package means;

zipper means connected to said covering means and responsive to an operator for providing access to a portion of the component parts of said breathing system located in said interior of the package means;

container means located in the interior of said package means for retaining a quantity of a first breathable fluid;

first control means connected to said container means for regulating the flow of said first fluid from the container means;

actuator means associated with said first control means and responsive to an operator input to allow said first breathable fluid to continually flow from said container means;

conduit means connected to said first control means for directing the flow of said first fluid away from said container means;

hood means connected to said conduit means, said hood means forming a seal with said person to prevent any of the irrespirable atmosphere from reaching the nose and mouth area of said person;

reservoir means connected to said hood means for establishing a mixing chamber for mixing the first breathable fluid with breathed fluid to replenish metabolic oxygen consumed during breathing;

first one-way check valve means for permitting inhalation by the person of breathable fluid from the reservoir means a relief chamber communicating with said hood means into said hood means;

second one-way check valve means connected to said hood means for permitting exhalation of breathed fluid by the person into said relief chamber, said relief chamber being connected to said reservoir means to allow a portion of the breathed fluid to be communicated to the mixing chamber;

filter means located between the relief chamber and the reservoir means for removing any water vapor and carbon dioxide from the breathed fluid before being communicated to the mixing chamber;

relief valve means located in the relief chamber for maintaining the pressure in the mixing chamber within a predetermined range; and curtain means attached to said hood means and extending to the shoulders of the person to further protect the person from any harmful conditions present in said irrespirable atmosphere.

2. The closed loop breathing system, as recited in claim 1 wherein said container means further includes;

gauge means for indicating in time, the quantity of said first fluid available for sustaining a person's rate of oxygen consumption.

3. The closed loop breathing system, as recited in claim 2 wherein said control means includes:

seal means for covering an opening from the container means;

plunger means connected to said zipper means for rupturing said seal means upon removal of the covering means around the packaging means; and restrictor means connected to said opening for establishing the flow rate of said first fluid to said conduit means.

4. The closed loop breathing system, as recited in claim 3 wherein said hood means includes:

bubble means for encapsulating the head of the person, said bubble means having an opening with a seal therearound for engaging the neck of the person to prevent escape of breathable fluid from the bubble.

5. The closed loop breathing system, as recited in claim 4 wherein said hood means further includes:

relief valve means for maintaining the pressure of breathable fluid within the bubble means within a predetermined range.

6. The closed loop breathing system, as recited in claim 5 wherein said filter means includes:

first barrier means for removing water vapor from the breathed air before being presented to the mixing chamber; and second barrier means concentric to the first barrier means for removal of carbon dioxide from the breathed air to maintain the metabolic activity of the person with acceptable limits.

7. The closed loop breathing system, as recited in claim 1 wherein said hood means includes:

face mask means connected to said second control means having an expandable strap for holding the mask against the face to establish said seal.

8. The closed loop breathing system, as recited in claim 7 wherein said hood means further includes:

a cap having a metalized reflective surface thereon to reduce the transfer of thermal energy from the irrespirable atmosphere.

9. A closed loop breathing system for providing a person with a breathable fluid while in an irrespirable atmosphere, comprising:

package means attachable to the torso of the person by a belt;

covering means attached to said package means for preventing the transmission of contaminants into the interior of said package means;

fastener means connected to said covering means and responsive to the person for providing access to a portion of the interior of the package means;

container means located in the interior of said package means for retaining a quantity of a first fluid;

seal means for covering an opening in said container means;

plunger means connected to said container means and responsive to said person for rupturing said seal means and allowing said first fluid to flow from said container means through the opening;

control means connected to said container means for regulating the flow rate of said first fluid from said container means;

pressure reducer means connected to said control means for allowing said first fluid to continually flow from said container means;

conduit means connected to said pressure reducer means for directing the flow of said first fluid away from said pressure reducer means;

hood means connected to said conduit means, said hood means having a flexible surface with sealing means adapted to engage the neck of the person and prevent any of the irrespirable atmosphere from being communicated to the nose and mouth area of the person;

injector means connected to said conduit means for allowing said first fluid to continually flow into said hood means to form a bubble which surrounds the head of the person;

a mixing chamber communicating with the interior of said hood means, said injector means terminating in said mixing chamber;

filter means connected to said hood means and said injector means for removing any water vapor and carbon dioxide said filter means communicates with the interior of said hood means and said mixing chamber whereby breathed fluid is communicated through said filter means into said mixing chamber as a result of a pressure differential being created when said first fluid is continually communicated to said hood means, said first fluid and said breathed fluid being combined in the mixing chamber to provide breathable fluid before being communicated to said bubble, said breathable fluid being breathed by the person from the bubble to sustain metabolic needs for a predetermined period of time, said flow of the breathed fluid through the filter means and the breathable fluid into the bubble providing continuous cooling of the head area of the person; and escape means for maintaining the pressure of the breathable fluid in the bubble under a predetermined pressure.

10. In the closed loop breathing system, as recited in claim 9 wherein said filter means includes:

first barrier means adjacent the injector means for removing water vapor from the breathed air before being presented to the mixing chamber; and second barrier means concentric to the first barrier means for removal of carbon dioxide from the breathed air to maintain the metabolic activity of the person with acceptable limits.

11. In the closed loop breathing system, as recited in claim 10 wherein said hood means includes:

curtain means attached to said hood means and extending over the shoulders of the person to provide further protection for any harmful conditions present in the irrespirable atmosphere.

* * * * *